US010515583B2

(12) United States Patent
Hwang et al.

(10) Patent No.: US 10,515,583 B2
(45) Date of Patent: Dec. 24, 2019

(54) BRIGHTNESS COMPENSATION SYSTEM AND BRIGHTNESS COMPENSATING METHOD OF OLED DISPLAY DEVICE

(71) Applicant: Shenzhen China Star Optoelectronics Technology Co., Ltd., Shenzhen (CN)

(72) Inventors: Taijiun Hwang, Shenzhen (CN); Yuchao Zeng, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 321 days.

(21) Appl. No.: 15/542,655

(22) PCT Filed: Jun. 14, 2017

(86) PCT No.: PCT/CN2017/088166
§ 371 (c)(1),
(2) Date: Jul. 11, 2017

(87) PCT Pub. No.: WO2018/196119
PCT Pub. Date: Nov. 1, 2018

(65) Prior Publication Data

US 2018/0308422 A1 Oct. 25, 2018

(30) Foreign Application Priority Data

Apr. 24, 2017 (CN) ..... 2017 1 0271547

(51) Int. Cl.
*G09G 3/32* (2016.01)
*G09G 3/3208* (2016.01)

(52) U.S. Cl.
CPC ... *G09G 3/3208* (2013.01); *G09G 2320/0233* (2013.01); *G09G 2320/045* (2013.01); *G09G 2320/066* (2013.01)

(58) Field of Classification Search
CPC combination set(s) only.
See application file for complete search history.

(56) References Cited

U.S. PATENT DOCUMENTS

2014/0307002 A1* 10/2014 Lee ..... G09G 3/2096 345/690
2014/0320552 A1* 10/2014 Seo ..... G09G 3/3648 345/690

(Continued)

FOREIGN PATENT DOCUMENTS

CN 103310765 A 9/2013
CN 103489405 A 1/2014

(Continued)

*Primary Examiner* — Chanh D Nguyen
*Assistant Examiner* — Nguyen H Truong
(74) *Attorney, Agent, or Firm* — Leong C. Lei

(57) ABSTRACT

The present invention provides a brightness compensation system and a brightness compensating method of an OLED display device, which comprises: an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit; which can prevent the brightness of the OLED display device from being degraded by the aging of the OLED display device, to ensure the display quality of the OLED display device, and to enhance the user experience and the product competitiveness.

13 Claims, 4 Drawing Sheets

(56) References Cited

U.S. PATENT DOCUMENTS

| | | | | |
|---|---|---|---|---|
| 2016/0104411 | A1* | 4/2016 | Nathan | G09G 3/2007<br>345/690 |
| 2018/0082634 | A1* | 3/2018 | Wang | G09G 3/3233 |

FOREIGN PATENT DOCUMENTS

| | | | |
|---|---|---|---|
| CN | 105070248 | A | 11/2015 |
| CN | 105096829 | A | 11/2015 |
| CN | 106847180 | A | 6/2017 |
| WO | WO2006087327 | A1 | 8/2006 |

* cited by examiner

BRIGHTNESS COMPENSATION SYSTEM AND BRIGHTNESS COMPENSATING METHOD OF OLED DISPLAY DEVICE

BACKGROUND OF THE INVENTION

Field of Invention

The present invention relates to the field of liquid crystal display, and more particularly to a brightness compensation system and a brightness compensating method of an OLED display device.

Description of Prior Art

The organic light-emitting diode displays (OLED) own various advantages, such as being self-luminous, low driving voltage, high light emission efficiency, short response time, high clarity and contrast, virtually 180° view angle, wide temperature range of applications, being capable of flexible displaying, and full color displaying in large area, and are considered a display device with the best potential of development.

The OLED is a current-driving element. When the electrical current flows through the organic light emitting diode, the organic light emitting diode emits light, and the brightness is determined according to the current flowing through the organic light emitting diode itself. Most of the present Integrated Circuits (IC) only transmits voltage signals. Therefore, the pixel driving circuit of the OLED needs to accomplish the mission of converting the voltage signals into the current signals. The typical pixel driving circuit of the OLED device is usually a 2T1C structure, which is constituted of a switching thin film transistor, a driving thin film transistor and a storage capacitor. The switching thin film transistor is turned on by a scanning signal, and a data signal is written into a gate electrode of the driving thin film transistor via the switching thin film transistor, to turn on the driving thin film transistor, then the organic light emitting diode emits light. As the using time increases, both the driving thin film transistor and the organic light emitting diode will age, causing the threshold voltage of the driving thin film transistor to drift, the brightness of the organic light emitting diode to attenuate, the brightness of the OLED device is getting lower and lower.

Hence, in order to ensure the quality of display, the OLED display device usually further provided with a brightness compensation system, shown in FIG. 1, a brightness compensation system of a conventional OLED display device, which comprises: an image pre-processing unit 100, an aging compensation unit 200 electrically connected to the image pre-processing unit 100, an aging-parameter detection unit 300 electrically connected to the aging compensation unit 200 and an OLED display panel 400 electrically connected to the aging compensation unit 200 and the aging-parameter detection unit 300. Its working process: aging parameters of the OLED display panel 400 (i.e., the threshold voltage of the driving thin film transistor currently) is detected by the aging-parameter detection unit 300, the aging compensation unit 200 increases the pixel voltage of a to-be-displayed image according to the aging parameters of the OLED display panel 400, to compensate the brightness of the OLED display panel 400. However, as time goes by, the aging parameters become larger, however, the pixel voltage can be provided by the hardware system is limited and could not be increased unlimitedly, when the pixel voltage reaches the upper limit, while the aging parameters continue to increase, the brightness of the OLED display panel 400 will be lower, making the user's experience worse and affecting the product competitiveness.

SUMMARY OF THE INVENTION

The object of the present invention is to provide a brightness compensation system of an OLED display device, which can prevent the brightness of the OLED display device from being degraded by the aging of the OLED display device, to ensure the display quality of the OLED display device, and to enhance the user experience and the product competitiveness.

The object of the present invention is to further provide a brightness compensating method of an OLED display device, which can prevent the brightness of the OLED display device from being degraded by the aging of the OLED display device, to ensure the display quality of the OLED display device, and to enhance the user experience and the product competitiveness.

In order to achieve the objective, the present invention provides a brightness compensation system of an OLED display device, which comprises: an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit.

A plurality of pixels are provided in the OLED display panel.

The image pre-processing unit is configured to provide display data of each of the pixels of a to-be-displayed image to the image-contrast control unit.

The aging-parameter detection unit is configured to detect aging parameters of the OLED display panel and to provide the aging parameters of the OLED display panel to the image-contrast control unit and the aging compensation unit.

The image-contrast control unit is configured to correspondingly adjust the display data of each of the pixels of the to-be-displayed image according to the aging parameters of the OLED display panel to raise the contrast of the to-be-displayed image and to provide the display data of each of the pixels after a contrast promotion to the aging compensation unit.

The aging compensation unit is configured to correspondingly adjust the display data of each of the pixels after the contrast promotion according to the aging parameters of the OLED display panel to perform an aging compensation and to provide the display data of each of the pixels after the aging compensation to the OLED display panel display for display.

The aging parameter is an average value of threshold voltage of a driving thin film transistor of a pixel driving circuit in each of the pixels at the current time, and the display data of each of the pixels is a brightness value of each of the pixels.

The image-contrast control unit calculates to derive a brightness-threshold value based on the brightness value of each of the pixels and a preset brightness threshold according to a preset brightness-threshold calculation formula, and compares the brightness value of each of the pixels with the brightness threshold value. When the brightness value of the pixel is larger than the brightness threshold, the brightness of the pixel is increased according to the aging parameter and a preset brightness-increment formula. When the brightness value of the pixel is less than or equal to the brightness threshold value, the brightness value of the pixel is decreased according to the aging parameter and a preset brightness-decrement formula.

The preset brightness-threshold calculation formula is as below:

$$M = 80\% \cdot AveY = 80\% \cdot \prod_{i=1}^{n} \sqrt[n]{Y_i};$$

Wherein M is the brightness threshold, AveY is a geometric mean brightness of the to-be-displayed image, n is a total number of the pixels of the OLED display panel, $Y_i$ is a brightness value of the i (th) pixel.

The preset brightness-increment formula is as below:

$$Y_i' = 255 - (255 - M) \cdot \left(\frac{255 - Y_i}{255 - M}\right)^b;$$

The preset brightness-decrement formula is as below:

$$Y_i' = M \cdot \left(\frac{Y_i}{M}\right)^a;$$

Wherein, $$a = \frac{V_{max} - Vth_{ini}}{V_{max} - V_{th}},\ b = \frac{V_{max} - V_{th}}{V_{max} - Vth_{ini}},$$

$Y'_I$ is a brightness value of the i (th) pixel after the contrast promotion, $V_{max}$ is a maximum voltage value possibly derived by the pixel of the OLED display panel, $Vth_{ini}$ is a reference value of the threshold voltage of the driving thin film transistor of the preset OLED display panel, $V_{th}$ is the aging parameter detected by the age-parameter detection unit.

The present invention further provides a brightness compensating method of an OLED display device, which comprises:

Step 1, a brightness compensation system is provided, which comprises an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit.

Step 2, display data of each of the pixels of a to-be-displayed image to the image-contrast control unit is provided by the image pre-processing unit.

Step 3, the aging-parameter detection unit detects aging parameters of the OLED display panel and provides the aging parameters of the OLED display panel to the image-contrast control unit and the aging compensation unit.

Step 4, the display data of each of the pixels of the to-be-displayed image is correspondingly adjusted by the image-contrast control unit according to the aging parameters of the OLED display panel, to raise the contrast of the to-be-displayed image and to provide the display data of each of the pixels after a contrast promotion to the aging compensation unit.

Step 5, the display data of each of the pixels after the contrast promotion is correspondingly adjusted by the aging compensation unit according to the aging parameters of the OLED display panel, to perform an aging compensation and to provide the display data of each of the pixels after the aging compensation to the OLED display panel display for display.

The aging parameter of the OLED display panel detected by the step 3 is an average value of threshold voltage of a driving thin film transistor of a pixel driving circuit in each of the pixels at the current time. The display data of each of the pixels provided by the step 2 is a brightness value of each of the pixels.

In the step 4, the image-contrast control unit calculates to derive a brightness-threshold value based on the brightness value of each of the pixels and a preset brightness threshold according to a preset brightness-threshold calculation formula, and compares the brightness value of each of the pixels with the brightness threshold value. When the brightness value of the pixel is larger than the brightness threshold, the brightness of the pixel is increased according to the aging parameter and a preset brightness-increment formula. When the brightness value of the pixel is less than or equal to the brightness threshold value, the brightness value of the pixel is decreased according to the aging parameter and a preset brightness-decrement formula.

The preset brightness-threshold calculation formula is as below:

$$M = 80\% \cdot AveY = 80\% \cdot \prod_{i=1}^{n} \sqrt[n]{Y_i};$$

Wherein M is the brightness threshold, AveY is a geometric mean brightness of the to-be-displayed image, n is a total number of the pixels of the OLED display panel, $Y_i$ is a brightness value of the i (th) pixel.

The preset brightness-increment formula is as below:

$$Y_i' = 255 - (255 - M) \cdot \left(\frac{255 - Y_i}{255 - M}\right)b;$$

The preset brightness-decrement formula is as below:

$$Y_i' = M \cdot \left(\frac{Y_i}{M}\right)^a;$$

Wherein, $$a = \frac{V_{max} - Vth_{ini}}{V_{max} - V_{th}},\ b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel, $Vth_{ini}$ is a reference value of the threshold voltage of the driving thin film transistor of the preset OLED display panel, $V_{th}$ is the aging parameter detected by the age-parameter detection unit.

The present invention further provides a brightness compensation system of an OLED display device, which comprises: an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit.

A plurality of pixels are provided in the OLED display panel.

The image pre-processing unit is configured to provide display data of each of the pixels of a to-be-displayed image to the image-contrast control unit.

The aging-parameter detection unit is configured to detect aging parameters of the OLED display panel and to provide the aging parameters of the OLED display panel to the image-contrast control unit and the aging compensation unit.

The image-contrast control unit is configured to correspondingly adjust the display data of each of the pixels of the to-be-displayed image according to the aging parameters of the OLED display panel to raise the contrast of the to-be-displayed image and to provide the display data of each of the pixels after a contrast promotion to the aging compensation unit.

The aging compensation unit is configured to correspondingly adjust the display data of each of the pixels after the contrast promotion according to the aging parameters of the OLED display panel to perform an aging compensation and to provide the display data of each of the pixels after the aging compensation to the OLED display panel display for display.

Wherein the aging parameter is an average value of threshold voltage of a driving thin film transistor of a pixel driving circuit in each of the pixels at the current time, and the display data of each of the pixels is a brightness value of each of the pixels.

Wherein the image-contrast control unit calculates to derive a brightness-threshold value based on the brightness value of each of the pixels and a preset brightness threshold according to a preset brightness-threshold calculation formula, and compares the brightness value of each of the pixels with the brightness threshold value. When the brightness value of the pixel is larger than the brightness threshold, the brightness of the pixel is increased according to the aging parameter and a preset brightness-increment formula. When the brightness value of the pixel is less than or equal to the brightness threshold value, the brightness value of the pixel is decreased according to the aging parameter and a preset brightness-decrement formula.

The beneficial effects of the present invention are: the present invention provides a brightness compensation system of an OLED display device, which comprises: an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit. Before the aging compensation, the image-contrast control unit increases the contrast of the to-be-displayed image according to the aging parameters, and to perform the aging compensation to the to-be-displayed image after the contrast promotion and display it, which can prevent the brightness of the OLED display device from being degraded by the aging of the OLED display device, to ensure the display quality of the OLED display device, and to enhance the user experience and the product competitiveness. The present invention further provides a brightness compensating method of an OLED display device, which can prevent the brightness of the OLED display device from being degraded by the aging of the OLED display device, to ensure the display quality of the OLED display device, and to enhance the user experience and the product competitiveness.

BRIEF DESCRIPTION OF THE DRAWINGS

For better understanding the technical proposals and other beneficial effects of the present invention, please refer the following detailed description of the present invention with the accompanying drawings.

In drawings.

DETAILED DESCRIPTION OF THE PREFERRED EMBODIMENTS

The technical proposals and the effects of the present invention will be described in further detail with reference to the below preferred embodiments of the present invention and their accompanying drawings.

Figure 1:
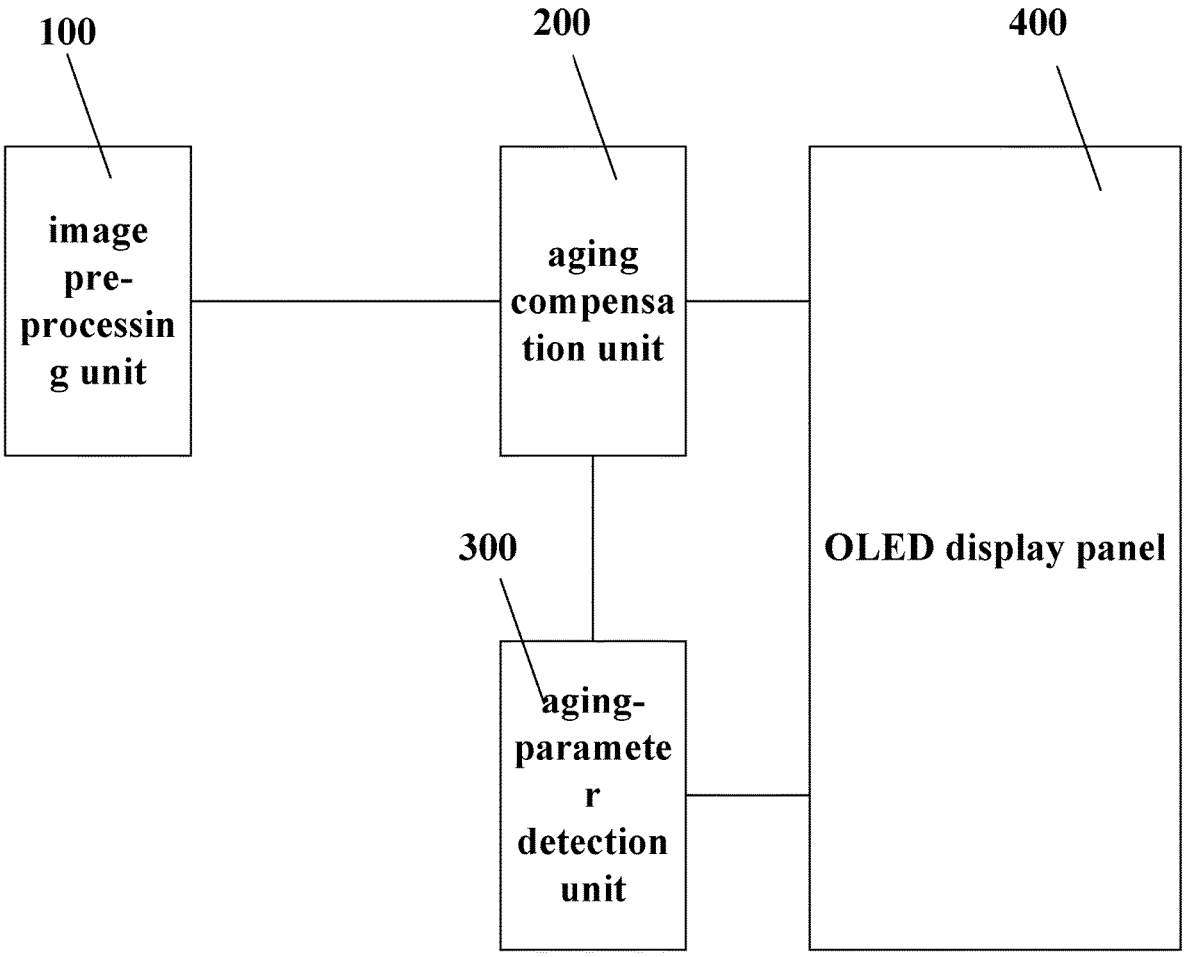
FIG. 1 is a structural diagram of a brightness compensation system of a conventional OLED display device.
Figure 2:
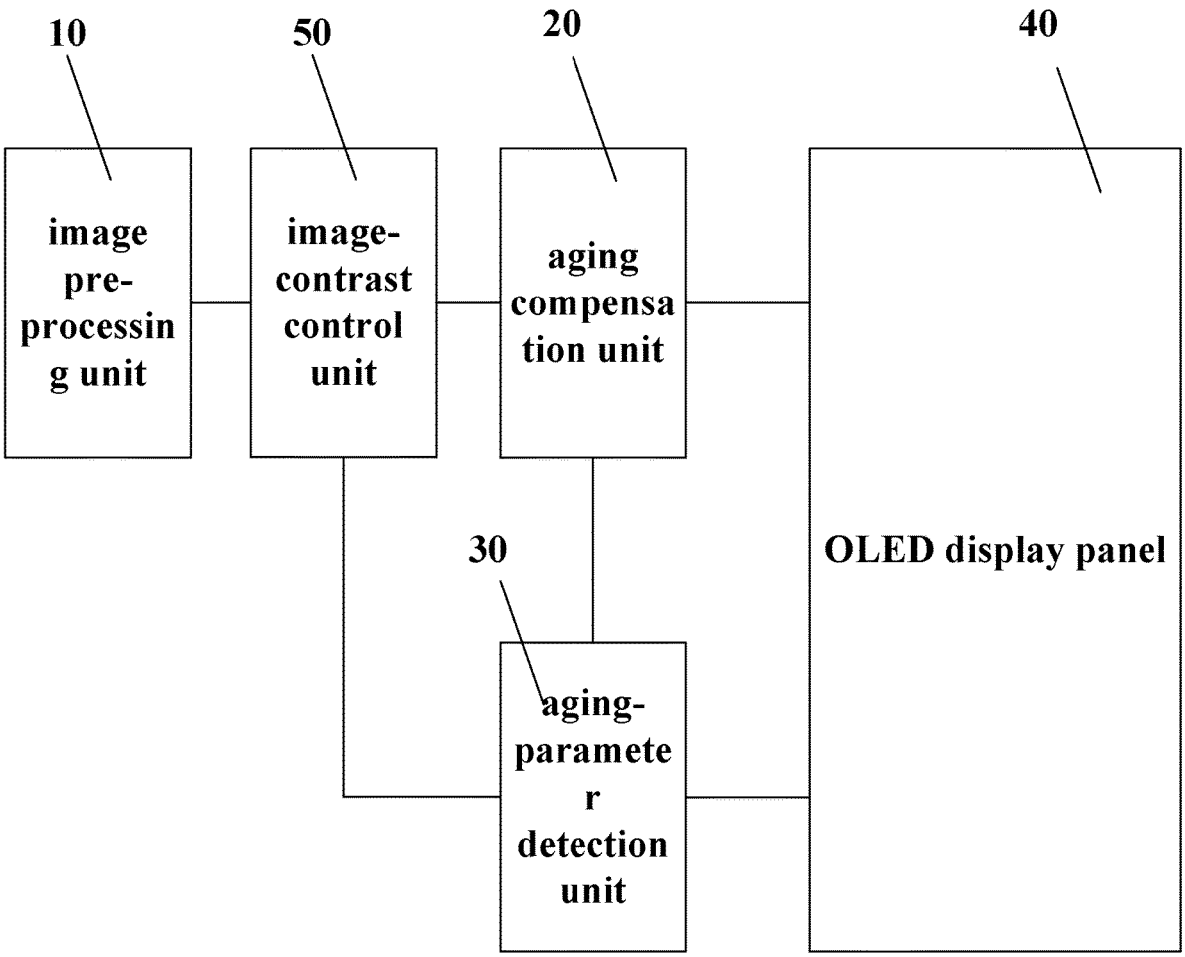
FIG. 2 is a structural diagram of a brightness compensation system of an OLED display device of the present invention.

Please refer to FIG. 2, the present invention provides a structural diagram of a brightness compensation system of an OLED display device, which comprises: an image pre-processing unit 10, an image-contrast control unit 50 electrically connected to the image pre-processing unit 10, an aging compensation unit 20 electrically connected to the image-contrast control unit 50, an aging-parameter detection unit 30 electrically connecting the aging compensation unit 20 and the image-contrast control unit 50, and an OLED display panel 40 electrically connected to the aging compensation unit 20 and the aging-parameter detection unit 30.

Wherein a plurality of pixels are provided in the OLED display panel 40, generally, the pixels are in an array arrangement.

The image pre-processing unit 10 is configured to provide display data of each of the pixels of a to-be-displayed image to the image-contrast control unit 50.

Specifically, in the preferred embodiment of the present invention, the display data of each of the pixels refers to the brightness value of each of the pixels.

The aging-parameter detection unit 30 is configured to detect aging parameters of the OLED display panel 40 and to provide the aging parameters of the OLED display panel to the image-contrast control unit 50 and the aging compensation unit 20.

Specifically, in the preferred embodiment of the present invention, the aging parameter is an average value of threshold voltage of a driving thin film transistor of a pixel driving circuit in each of the pixels.

The image-contrast control unit 50 is configured to correspondingly adjust the display data of each of the pixels of the to-be-displayed image according to the aging parameters of the OLED display panel 40 to raise the contrast of the to-be-displayed image and to provide the display data of each of the pixels after a contrast promotion to the aging compensation unit 20.

Figure 3:
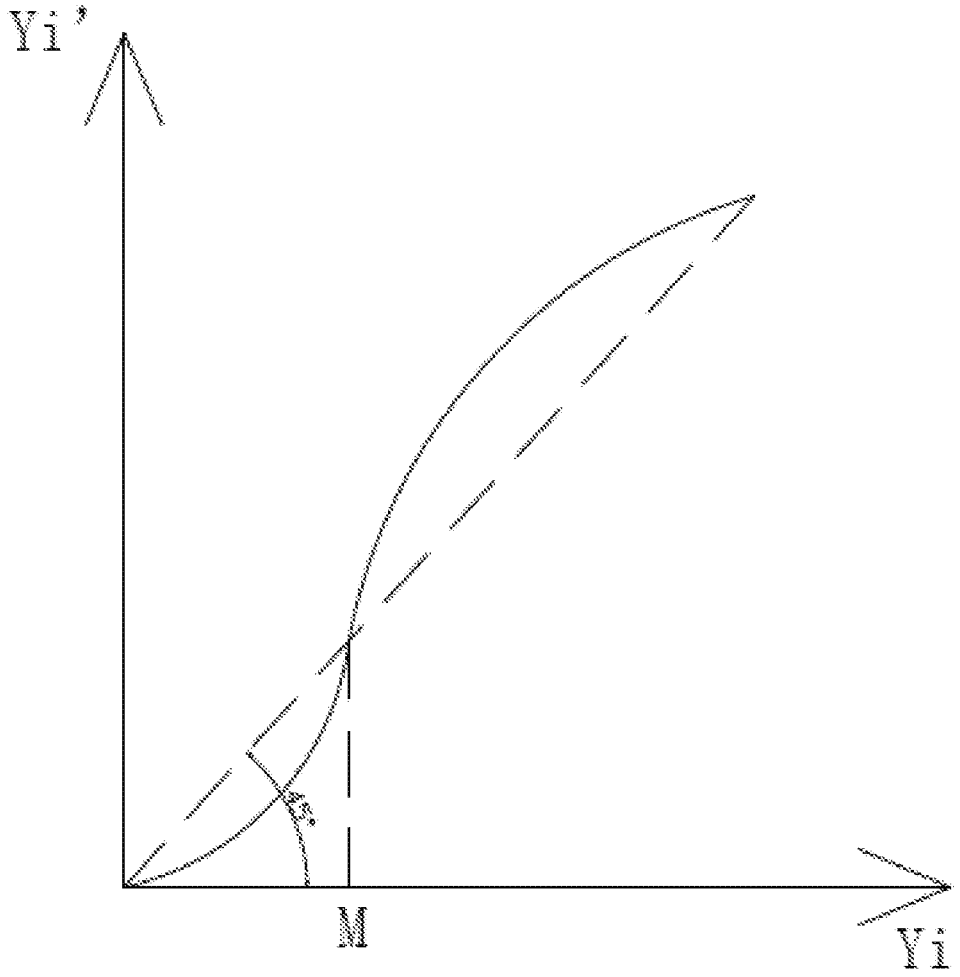
FIG. 3 is a waveform diagram of the step 3 of a brightness compensating method of an OLED display device of the present invention.

Furthermore, please refer to FIG. 3, as the dash line in FIG. 3 shoes that the brightness value of each of the pixels input to the aging compensation unit 20 is equal to the brightness value outputted from the image pre-processing unit 10, when the contrast promotion is not performed; and as the solid line in FIG. 3, after the contrast promotion, a higher brightness value of the pixel outputted from the image preprocessing unit 10, then, a much higher brightness value of the pixel is input to the aging compensation unit 20. In other words, the image-contrast control unit 50 enhances the contrast of the to-be-displayed image by making the original brighter pixels to be much brighter and the original darker pixel to be much darker.

Specifically, firstly, a brightness-threshold value is derived based on the brightness value of each of the pixels and a preset brightness threshold according to a preset brightness-threshold calculation formula, and compares the brightness value of each of the pixels with the brightness threshold value. When the brightness value of the pixel is larger than the brightness threshold, the brightness of the pixel is increased according to the aging parameter and a preset brightness-increment formula. When the brightness value of the pixel is less than or equal to the brightness threshold value, the brightness value of the pixel is decreased according to the aging parameter and a preset brightness-decrement formula.

In detail, the preset brightness-threshold calculation formula is as below:

$$M = 80\% \cdot AveY = 80\% \cdot \prod_{i=1}^{n} \sqrt[n]{Y_i};$$

Wherein M is the brightness threshold, AveY is a geometric mean brightness of the to-be-displayed image, n is a total number of the pixels of the OLED display panel 40, $Y_i$ is a brightness value of the i (th) pixel.

The preset brightness-increment formula is as below:

$$Y_i' = 255 - (255 - M) \cdot \left(\frac{255 - Y_i}{255 - M}\right)^b;$$

The preset brightness-decrement formula is as below:

$$Y_i' = M \cdot \left(\frac{Y_i}{M}\right)^a;$$

Wherein, $$a = \frac{V_{max} - Vth_{ini}}{V_{max} - V_{th}},\ b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel 40, $Vth_{ini}$ is a reference value of the threshold voltage of the driving thin film transistor of the preset OLED display panel 40, $V_{th}$ is the aging parameter detected by the age-parameter detection unit 30.

Preferably, the reference value of the threshold voltage of the driving thin film transistor of the preset OLED display panel 40 is a mean value of the threshold voltage of the driving thin film transistor of the preset OLED display panel 40 before leaving the factory.

The aging compensation unit 20 is configured to correspondingly adjust the display data of each of the pixels after the contrast promotion according to the aging parameters of the OLED display panel 40 to perform an aging compensation and to provide the display data of each of the pixels after the aging compensation to the OLED display panel display 40 for display.

Specifically, the method of aging compensation is the conventional art and will not be described here.

It should be noted that since the contrast of the to-be-displayed image is improved before the aging compensation, it is possible to prevent the brightness of the OLED display device from being degraded by the aging of the OLED display device, to ensure the display quality of the OLED display device, and to enhance the user experience and the product competitiveness.

Figure 4:
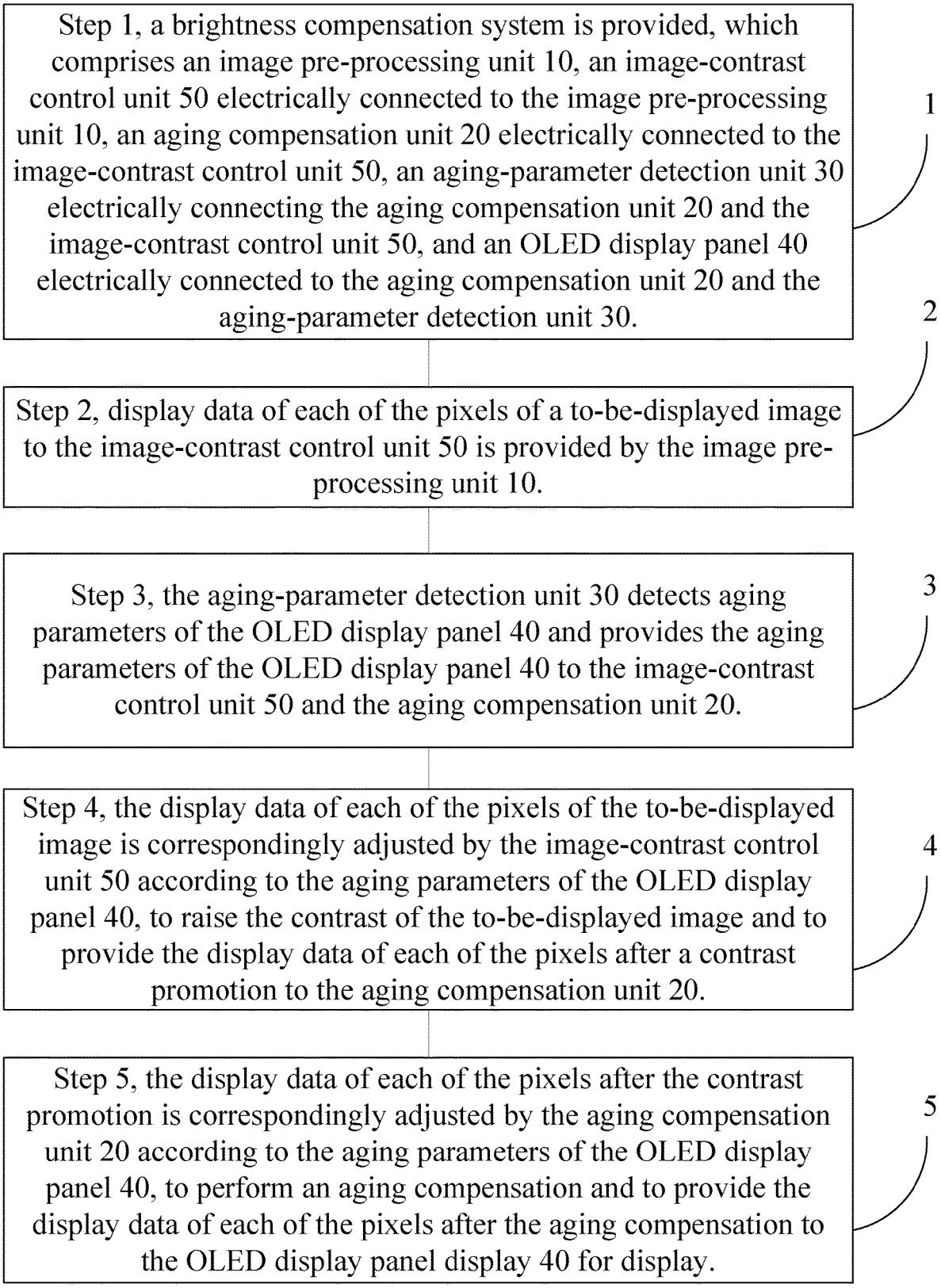
FIG. 4 is a flow diagram of a brightness compensating method of an OLED display device of the present invention.

Please refer to FIG. 4, the present invention further provides a brightness compensating method of an OLED display device, which comprises below steps:

Step 1, please refer to FIG. 2, a brightness compensation system is provided, which comprises an image pre-processing unit 10, an image-contrast control unit 50 electrically connected to the image pre-processing unit 10, an aging compensation unit 20 electrically connected to the image-contrast control unit 50, an aging-parameter detection unit 30 electrically connecting the aging compensation unit 20 and the image-contrast control unit 50, and an OLED display panel 40 electrically connected to the aging compensation unit 20 and the aging-parameter detection unit 30.

Step 2, display data of each of the pixels of a to-be-displayed image to the image-contrast control unit 50 is provided by the image pre-processing unit 10.

Specifically, the display data of each of the pixels provided by the step 2 is a brightness value of each of the pixels.

Step 3, the aging-parameter detection unit 30 detects aging parameters of the OLED display panel 40 and provides the aging parameters of the OLED display panel 40 to the image-contrast control unit 50 and the aging compensation unit 20.

Specifically, the aging parameter of the OLED display panel 40 detected by the step 3 is an average value of threshold voltage of a driving thin film transistor of a pixel driving circuit in each of the pixels at the current time.

Step 4, the display data of each of the pixels of the to-be-displayed image is correspondingly adjusted by the image-contrast control unit 50 according to the aging parameters of the OLED display panel 40, to raise the contrast of the to-be-displayed image and to provide the display data of each of the pixels after a contrast promotion to the aging compensation unit 20.

Furthermore, please refer to FIG. 3, as the dash line in FIG. 3 shoes that the brightness value of each of the pixels input to the aging compensation unit 20 is equal to the brightness value outputted from the image pre-processing unit 10, when the contrast promotion is not performed; and as the solid line in FIG. 3, after the contrast promotion, a higher brightness value of the pixel outputted from the image preprocessing unit 10, then, a much higher brightness value of the pixel is input to the aging compensation unit 20.

That is, in the step 4, the image-contrast control unit 50 enhances the contrast of the to-be-displayed image by making the original brighter pixels to be much brighter and the original darker pixel to be much darker.

Specifically, firstly, a brightness-threshold value is derived based on the brightness value of each of the pixels and a preset brightness threshold according to a preset brightness-threshold calculation formula, and compares the brightness value of each of the pixels with the brightness threshold value. When the brightness value of the pixel is larger than the brightness threshold, the brightness of the pixel is increased according to the aging parameter and a preset brightness-increment formula. When the brightness value of the pixel is less than or equal to the brightness threshold value, the brightness value of the pixel is decreased according to the aging parameter and a preset brightness-decrement formula.

In detail, the preset brightness-threshold calculation formula is as below:

$$M = 80\% \cdot AveY = 80\% \cdot \prod_{i=1}^{n} \sqrt[n]{Y_i};$$

Wherein M is the brightness threshold, AveY is a geometric mean brightness of the to-be-displayed image, n is a total number of the pixels of the OLED display panel 40, $Y_i$ is a brightness value of the i (th) pixel.

The preset brightness-increment formula is as below:

$$Y_i' = 255 - (255 - M) \cdot \left(\frac{255 - Y_i}{255 - M}\right)^b;$$

The preset brightness-decrement formula is as below:

$$Y_i' = M \cdot \left(\frac{Y_i}{M}\right)^a;$$

Wherein, $$a = \frac{V_{max} - Vth_{ini}}{V_{max} - V_{th}},$$

$$b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel 40, $Vth_{ini}$ is a reference value of the threshold voltage of the driving thin film transistor of the preset OLED display panel 40, $V_{th}$ is the aging parameter detected by the age-parameter detection unit 30.

Preferably, the reference value of the threshold voltage of the driving thin film transistor of the preset OLED display panel 40 is a mean value of the threshold voltage of the driving thin film transistor of the preset OLED display panel 40 before leaving the factory.

Step 5, the display data of each of the pixels after the contrast promotion is correspondingly adjusted by the aging compensation unit 20 according to the aging parameters of the OLED display panel 40, to perform an aging compensation and to provide the display data of each of the pixels after the aging compensation to the OLED display panel display 40 for display.

Specifically, the method of aging compensation is the conventional art and will not be described here.

It should be noted that since the contrast of the to-be-displayed image is improved before the aging compensation, it is possible to prevent the brightness of the OLED display device from being degraded by the aging of the OLED display device, to ensure the display quality of the OLED display device, and to enhance the user experience and the product competitiveness.

As mentioned above, the present invention provides a brightness compensation system of an OLED display device, which comprises: an image pre-processing unit, an image-contrast control unit electrically connected to the image pre-processing unit, an aging compensation unit electrically connected to the image-contrast control unit, an aging-parameter detection unit electrically connecting the aging compensation unit and the image-contrast control unit, and an OLED display panel electrically connected to the aging compensation unit and the aging-parameter detection unit; which can prevent the brightness of the OLED display device from being degraded by the aging of the OLED display device, to ensure the display quality of the OLED display device, and to enhance the user experience and the product competitiveness. The present invention further provides a brightness compensating method of an OLED display device, which can prevent the brightness of the OLED display device from being degraded by the aging of the OLED display device, to ensure the display quality of the OLED display device, and to enhance the user experience and the product competitiveness.

As mentioned above, those of ordinary skill in the art, without departing from the spirit and scope of the present disclosure, can make various kinds of modifications and variations to the present disclosure. Therefore, all such modifications and variations are intended to be included in the protection scope of the appended claims of the present invention.

What is claimed is:

1. A brightness compensation system of an OLED display device, comprising: an image pre-processing processor, an image-contrast control processor electrically connected to the image pre-processing processor, an aging compensation processor electrically connected to the image-contrast control processor, an aging-parameter detection processor electrically connecting the aging compensation processor and the image-contrast control processor, and an OLED display panel electrically connected to the aging compensation processor and the aging-parameter detection processor;

a plurality of pixels being provided in the OLED display panel;

the image pre-processing processor being configured to provide display data of each of the pixels of a to-be-displayed image to the image-contrast control processor;

the aging-parameter detection processor being configured to detect aging parameters of the OLED display panel and to provide the aging parameters of the OLED display panel to the image-contrast control processor and the aging compensation processor;

the image-contrast controls processor being configured to correspondingly adjust the display data of each of the pixels of the to-be-displayed image according to the aging parameters of the OLED display panel, to raise the contrast of the to-be-displayed image and to provide the display data of each of the pixels after a contrast promotion to the aging compensation processor;

the aging compensation processor being configured to correspondingly adjust the display data of each of the pixels after the contrast promotion according to the aging parameters of the OLED display panel, to perform an aging compensation and to provide the display data of each of the pixels after the aging compensation to the OLED display panel display for display.

2. The brightness compensation system of an OLED display device according to claim 1, wherein the aging parameter is an average value of threshold voltage of a driving thin film transistor of a pixel driving circuit in each of the pixels at the current time, and the display data of each of the pixels is a brightness value of each of the pixels.

3. The brightness compensation system of an OLED display device according to claim 2, wherein the image-contrast control processor calculates to derive a brightness-threshold value based on the brightness value of each of the pixels and a preset brightness threshold according to a preset brightness-threshold calculation formula, and compares the brightness value of each of the pixels with the brightness threshold value, and when the brightness value of the pixel is larger than the brightness threshold, the brightness of the pixel is increased according to the aging parameter and a preset brightness-increment formula, when the brightness value of the pixel is less than or equal to the brightness threshold value, the brightness value of the pixel is decreased according to the aging parameter and a preset brightness-decrement formula.

4. The brightness compensation system of an OLED display device according to claim 3, wherein the preset brightness-threshold calculation formula is as below:

$$M = 80\% \cdot AveY = 80\% \cdot \prod_{i=1}^{n} \sqrt[n]{Y_i};$$

wherein M is the brightness threshold, AveY is a geometric mean brightness of the to-be-displayed image, n is a total number of the pixels of the OLED display panel, $Y_i$ is a brightness value of the i (th) pixel.

5. The brightness compensation system of an OLED display device according to claim 4, wherein the preset brightness-increment formula is as below:

$$Y_i' = 255 - (255 - M) \cdot \left(\frac{255 - Y_i}{255 - M}\right)^b;$$

the preset brightness-decrement formula is as below:

$$Y_i' = M \cdot \left(\frac{Y_i}{M}\right)^a;$$

wherein, $$a = \frac{V_{max} - Vth_{ini}}{V_{max} - V_{th}},$$

$$b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel, $Vth_{ini}$ is a reference value of the threshold voltage of the driving thin film transistor of the preset OLED display panel, $V_{th}$ is the aging parameter detected by the aging-parameter detection processor.

6. A brightness compensating method of an OLED display device, comprising:

step 1, providing a brightness compensation system, comprising an image pre-processing processor, an image-contrast control processor electrically connected to the image pre-processing processor, an aging compensation processor electrically connected to the image-contrast control processor, an aging-parameter detection processor electrically connecting the aging compensation processor and the image-contrast control processor, and an OLED display panel electrically connected to the aging compensation processor and the aging-parameter detection processor;

step 2, providing display data of each of the pixels of a to-be-displayed image to the image-contrast control processor by the image pre-processing processor;

step 3, detecting aging parameters of the OLED display panel and providing the aging parameters of the OLED display panel to the image-contrast control processor and the aging compensation processor by the aging-parameter detection processor;

step 4, correspondingly adjusting the display data of each of the pixels of the to-be-displayed image by the image-contrast control processor according to the aging parameters of the OLED display panel, to raise the contrast of the to-be-displayed image and to provide the display data of each of the pixels after a contrast promotion to the aging compensation processor;

step 5, correspondingly adjusting the display data of each of the pixels after the contrast promotion by the aging compensation processor according to the aging parameters of the OLED display panel, to perform an aging compensation and to provide the display data of each of the pixels after the aging compensation to the OLED display panel display for display.

7. The brightness compensating method of an OLED display device according to claim 6, wherein the aging parameter of the OLED display panel detected by the step 3 is an average value of threshold voltage of a driving thin film transistor of a pixel driving circuit in each of the pixels at the current time, and the display data of each of the pixels provided by the step 2 is a brightness value of each of the pixels.

8. The brightness compensating method of an OLED display device according to claim 7, wherein in the step 4, the image-contrast control processor calculates to derive a brightness-threshold value based on the brightness value of each of the pixels and a preset brightness threshold according to a preset brightness-threshold calculation formula, and compares the brightness value of each of the pixels with the brightness threshold value, and when the brightness value of the pixel is larger than the brightness threshold, the brightness of the pixel is increased according to the aging parameter and a preset brightness-increment formula, when the brightness value of the pixel is less than or equal to the brightness threshold value, the brightness value of the pixel is decreased according to the aging parameter and a preset brightness-decrement formula.

9. The brightness compensating method of an OLED display device according to claim 8, wherein the preset brightness-threshold calculation formula is as below:

$$M = 80\% \cdot AveY = 80\% \cdot \prod_{i=1}^{n} \sqrt[n]{Y_i};$$

wherein M is the brightness threshold, AveY is a geometric mean brightness of the to-be-displayed image, n is a total number of the pixels of the OLED display panel, $Y_i$ is a brightness value of the i (th) pixel.

10. The brightness compensating method of an OLED display device according to claim 9, wherein the preset brightness-increment formula is as below:

$$Y_i' = 255 - (255 - M) \cdot \left(\frac{255 - Y_i}{255 - M}\right)^b;$$

the preset brightness-decrement formula is as below:

$$Y_i' = M \cdot \left(\frac{Y_i}{M}\right)^a;$$

wherein, $$a = \frac{V_{max} - Vth_{ini}}{V_{max} - V_{th}},$$

$$b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel, $Vth_{ini}$ is a reference value of the threshold voltage of the driving thin film transistor of the preset OLED display panel, $V_{th}$ is the aging parameter detected by the aging-parameter detection processor.

11. A brightness compensation system of an OLED display device, comprising: an image pre-processing processor, an image-contrast control processor electrically connected to the image pre-processing processor, an aging compensation processor electrically connected to the image-contrast control processor, an aging-parameter detection processor electrically connecting the aging compensation processor and the image-contrast control processor, and an OLED display panel electrically connected to the aging compensation processor and the aging-parameter detection processor;

a plurality of pixels being provided in the OLED display panel;

the image pre-processing processor being configured to provide display data of each of the pixels of a to-be-displayed image to the image-contrast control processor;

the aging-parameter detection processor being configured to detect aging parameters of the OLED display panel and to provide the aging parameters of the OLED display panel to the image-contrast control processor and the aging compensation processor;

the image-contrast control processor being configured to correspondingly adjust the display data of each of the pixels of the to-be-displayed image according to the aging parameters of the OLED display panel, to raise the contrast of the to-be-displayed image and to provide the display data of each of the pixels after a contrast promotion to the aging compensation processor;

the aging compensation processor being configured to correspondingly adjust the display data of each of the pixels after the contrast promotion according to the aging parameters of the OLED display panel, to perform an aging compensation and to provide the display data of each of the pixels after the aging compensation to the OLED display panel display for display;

wherein the aging parameter is an average value of threshold voltage of a driving thin film transistor of a pixel driving circuit in each of the pixels at the current time, and the display data of each of the pixels is a brightness value of each of the pixels;

wherein the image-contrast control processor calculates to derive a brightness-threshold value based on the brightness value of each of the pixels and a preset brightness threshold according to a preset brightness-threshold calculation formula, and compares the brightness value of each of the pixels with the brightness threshold value, and when the brightness value of the pixel is larger than the brightness threshold, the brightness of the pixel is increased according to the aging parameter and a preset brightness-increment formula, when the brightness value of the pixel is less than or equal to the brightness threshold value, the brightness value of the pixel is decreased according to the aging parameter and a preset brightness-decrement formula.

12. The brightness compensation system of an OLED display device according to claim 11, wherein the preset brightness-threshold calculation formula is as below:

$$M = 80\% \cdot AveY = 80\% \cdot \prod_{i=1}^{n} \sqrt[n]{Y_i};$$

wherein M is the brightness threshold, AveY is a geometric mean brightness of the to-be-displayed image, n is a total number of the pixels of the OLED display panel, $Y_i$ is a brightness value of the i (th) pixel.

13. The brightness compensation system of an OLED display device according to claim 12, wherein the preset brightness-increment formula is as below:

$$Y_i' = 255 - (255 - M) \cdot \left(\frac{255 - Y_i}{255 - M}\right)^b;$$

the preset brightness-decrement formula is as below:

$$Y_i' = M \cdot \left(\frac{Y_i}{M}\right)^a;$$

wherein, $$a = \frac{V_{max} - Vth_{ini}}{V_{max} - V_{th}},$$

-continued $$b = \frac{V_{max} - V_{th}}{V_{max} - Vth_{ini}},$$

$Y'_I$ is a brightness value of the i(th) pixel after the contrast promotion, $V_{max}$ is a maximum voltage value possibly derived by the pixel of the OLED display panel, $Vth_{ini}$ is a reference value of the threshold voltage of the driving thin film transistor of the preset OLED display panel, $V_{th}$ is the aging parameter detected by the aging-parameter detection processor.

* * * * *